US007545246B2

(12) United States Patent
Kim et al.

(10) Patent No.: US 7,545,246 B2
(45) Date of Patent: Jun. 9, 2009

(54) PIEZOELECTRIC MEMS SWITCH AND METHOD OF FABRICATING THE SAME

(75) Inventors: Jong-seok Kim, Hwaseong-si (KR); In-sang Song, Seoul (KR); Sang-hun Lee, Seoul (KR); Sang-wook Kwon, Seongnam-si (KR); Chang-seung Lee, Yongin-si (KR); Young-tack Hong, Suwon-si (KR); Che-heung Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 325 days.

(21) Appl. No.: 11/515,717

(22) Filed: Sep. 6, 2006

(65) Prior Publication Data

US 2007/0231065 A1 Oct. 4, 2007

(30) Foreign Application Priority Data

Mar. 30, 2006 (KR) ..... 10-2006-0028991

(51) Int. Cl.
*H01H 51/22* (2006.01)

(52) U.S. Cl. ..... 335/78; 200/181; 310/330

(58) Field of Classification Search ..... 335/78; 200/181; 310/330–332

See application file for complete search history.

(56) References Cited

U.S. PATENT DOCUMENTS

| | | | | |
|---|---|---|---|---|
| 4,570,139 | A * | 2/1986 | Kroll | 335/187 |
| 5,578,976 | A * | 11/1996 | Yao | 333/262 |
| 6,359,374 | B1 * | 3/2002 | Dausch et al. | 310/330 |
| 6,531,668 | B1 * | 3/2003 | Ma | 200/181 |
| 7,215,064 | B2 * | 5/2007 | Mehta | 310/331 |

* cited by examiner

*Primary Examiner*—Elvin G Enad
*Assistant Examiner*—Bernard Rojas
(74) *Attorney, Agent, or Firm*—Sughrue Mion, PLLC

(57) ABSTRACT

A piezoelectric Micro Electro Mechanical System (MEMS) switch includes a substrate, first and second fixed signal lines symmetrically formed in a spaced-apart relation to each other on the substrate to have a predetermined gap therebetween, a piezoelectric actuator disposed in alignment with the first and the second fixed signal lines in the predetermined gap, and having a first end supported on the substrate to allow the piezoelectric actuator to be movable up and down, and a movable signal line having a first end connected to one of the first and the second fixed signal lines, and a second end configured to be in contact with, or separate from the other of the first and second fixed signal lines, the movable signal line at least one side thereof being connected to an upper surface of the piezoelectric actuator.

20 Claims, 7 Drawing Sheets

PIEZOELECTRIC MEMS SWITCH AND METHOD OF FABRICATING THE SAME

CROSS-REFERENCE TO RELATED PATENT APPLICATION

This application claims priority under 35 U.S.C. § 119 (a) from Korean Patent Application No. 10-2006-0028991 filed on Mar. 30, 2006 in the Korean Intellectual Property Office, the disclosure of which is incorporated herein by reference.

BACKGROUND OF THE INVENTION

1. Field of the Invention

Apparatuses and methods consistent with the present invention relate to a Micro Electro Mechanical System (MEMS) switch, such as a Radio Frequency (RF) switch, fabricated using a MEMS technique, and in particular, to a MEMS switch which is driven by using a piezoelectric element or actuator, and a method of fabricating the same.

2. Description of the Related Art

Recently, a lot of electronic systems, which are used at a high frequency band, are tending to reduce a weight to an ultra lightweight, to decrease a size to an ultra small size, and to enhance a performance in a high level. Accordingly, an ultra small-sized micro switch using a MEMS technique has been actively developed to substitute for a semiconductor switch, such as a field effect transistor (FET) or a PIN diode, which is using till now to control a signal in the electronic systems.

Among RF elements using the MEMS technique, an RF switch is most widely fabricated. The RF switch is used much in an impedance matching circuit or for selectively transmitting a signal in wireless communication terminals and systems of microwave or millimeter wave band.

As driving mechanisms for use in the RF switch using the MEMS technique, there are known driving mechanisms of various types, such as an electromagnetic type, a magnetic type, a piezoelectric type, an electrostatic type, etc.

According to a conventional electrostatic type MEMS switch, when a fixed electrode is applied with a DC voltage, electrification occurs between the fixed electrode and a movable electrode. Accordingly, the movable electrode is led under the influence of an electrostatic force, so that a contact member formed on the movable electrode comes into contact with or move away from a signal line formed on the substrate, thereby switching signal flow.

The conventional MEMS switch, however, uses the electrostatic force generated between the fixed electrode and the movable electrode as described above to switch the signal flow. Thus, there arises a problem that a high driving voltage should be applied to the movable electrode to drive the movable electrode.

Further, the conventional MEMS switch has a different shape according to a position of cell in a wafer in which it is formed. Thus, a gap between the fixed electrode and the movable electrode is not uniform, but different according to the MEMS switches, thereby uniformity in performances of the MEMS switches being deteriorated. Also, the conventional MEMS switch requires a large number of fabrication processes, thereby a productivity being deteriorated.

In addition, the conventional MEMS switch is disadvantageous in that a contact force of the contact member is unstable, and a contact loss is increased as the contact member repeats the switching operation.

FIG. 1 is a top plan view exemplifying a structure of conventional MEMS switch using a piezoelectric actuator.

Referring to FIG. 1, there is illustrated an upward driving type piezoelectric RF MEMS switch 20 using Pb(Zr, Ti)O3 (lead zirconate titanate) (PZT) as a material of the piezoelectric actuator such as a cantilever.

The piezoelectric RF MEMS switch 20 includes a substrate 1 having an RF input signal line 22*a* and an RF output signal line 22*b* plated thereon, and a plurality of cantilevers 21*a*, 21*b*, 21*c*, and 21*d* to support a contact pad 22. The contact pad 22 is located apart from and just below the RF input and output signal lines 22*a* and 22*b*.

The cantilevers 21*a*, 21*b*, 21*c*, and 21*d* are formed of an upper electrode layer (not shown), a piezoelectric layer (not shown), a lower electrode layer (not shown), and a membrane (not shown), respectively. When the layers of the cantilever 21*a*, 21*b*, 21*c*, and 21*d* are applied with a DC voltage, the cantilever 21*a*, 21*b*, 21*c*, and 21*d* are bended upward in a cavity 23*a*. As a result, the contact pad 22 formed on top ends of the cantilever 21*a*, 21*b*, 21*c*, and 21*d* comes in contact with the RF input and output signal lines 22*a* and 22*b* to interconnect them with each other, thereby transmitting an RF signal.

Such a conventional piezoelectric RF MEMS switch 20 is advantageous in that it is possible to drive the cantilevers with a voltage of less than 3V, e.g., to move the cantilevers having a length of about 100 μm by about 1.8 μm with the voltage of less than 3V, and there is almost no power consumption.

However, according to the conventional piezoelectric RF MEMS switch 20, there are a lot of difficulties in fabrication. More particularly, a fabrication process is complicated. In most of the piezoelectric RF MEMS switches, the piezoelectric layers and the membranes of the cantilevers are formed at a very high temperature. Thus, the piezoelectric layers and the membranes have to be formed prior to coplanar waveguide (CPW) wire lines including the RF signal lines. If the CPW wire lines are formed on the substrate and then the piezoelectric actuators are formed on the CPW wire lines, a metal is diffused from the CPW wire lines, or a silicide is formed, due to a high temperature. Due to such a restriction, as shown in FIG. 1, the piezoelectric RF MEMS switch should be configured, such that the cantilevers 21*a*, 21*b*, 21*c* and 21*d* are bended upward and the substrate 1 or a separate wafer is installed above the cantilevers 21*a*, 21*b*, 21*c* and 21*d* to form the CPW wire lines thereon. In this case, a rear surface (undersurface) of the substrate 1 should be unreasonably etched. In the conventional piezoelectric RF MEMS switch 20 shown in FIG. 1, the cantilevers 21*a*, 21*b*, 21*c* and 21*d* are formed by etching the undersurface of the substrate 1 after the upper surface of the substrate 1 is plated with the RF signal lines 22*a* and 22*b* by a plating process.

SUMMARY OF THE INVENTION

Exemplary embodiments of the present invention address at least the above aspects. Accordingly, an aspect of the present invention is to provide a piezoelectric MEMS switch in which a piezoelectric actuator is formed prior to RF signal lines, thereby removing a process of unreasonably etching an undersurface of a substrate and improving a degree of freedom in process design.

Another aspect of the present invention is to provide a piezoelectric MEMS switch in which a piezoelectric actuator has an improved driving performance.

Still another aspect of the present invention is to provide a piezoelectric MEMS switch in which RF signal lines have an improved contact structure, thereby reducing an RF loss.

Also another aspect of the present invention is to provide a method of fabricating a piezoelectric MEMS described as above.

Additional aspects of the invention will be set forth in part in the description which follows and, in part, will be obvious from the description, or may be learned by practice of the invention.

According to one aspect of an exemplary embodiment of the present invention, there is provided a piezoelectric MEMS switch comprising a substrate, first and second fixed signal lines symmetrically formed in a spaced-apart relation to each other on the substrate to have a predetermined gap therebetween, a piezoelectric actuator disposed in alignment with the first and the second fixed signal lines in the predetermined gap, and comprising a first end supported on the substrate to allow the piezoelectric actuator to be movable up and down, and a movable signal line comprising a first end connected to one of the first and the second fixed signal lines, and a second end configured to be in contact with, or separate from the other of the first and second fixed signal lines, the movable signal line at least one side thereof being connected to an upper surface of the piezoelectric actuator.

The substrate may have a first cavity formed below the predetermined gap to allow the piezoelectric actuator to be movable down.

The substrate may also have a second cavity formed at a side of the first cavity to waft a first end of the one of the first and the second fixed signal lines.

The movable signal line may comprise a first support which supports the first end of the movable signal line in a spaced-apart relation from the piezoelectric actuator, the first support being in contact with the first end of the one of the first and the second fixed signal lines wafted by the second cavity, a second support which supports the second end of the movable signal line in a spaced-apart relation from and on the upper surface of the piezoelectric actuator, and a contact which is extended from the second end of the movable signal line and selectively comes in contact with the other of the first and the second fixed signal lines.

The piezoelectric actuator may comprise a lower electrode layer, a piezoelectric layer formed on the lower electrode layer, an upper electrode layer formed on the piezoelectric layer, and a rigid layer formed on the upper electrode layer.

The piezoelectric actuator may further comprise a plurality of slits formed in a longitudinal direction of the first and the second fixed signal lines.

The piezoelectric MEMS switch may further comprise a driving voltage supplying unit which supplies a driving voltage to the upper and the lower electrode layers.

The driving voltage supplying unit may comprise a lower electrode driving voltage pad which is disposed at a side of the substrate and connected to the lower electrode layer of the piezoelectric actuator, an upper electrode driving voltage pad which is disposed at a side of the piezoelectric actuator and supplies a voltage to the upper electrode layer of the piezoelectric actuator, and a connecting pad which connects the upper electrode driving voltage pad to the upper electrode layer of the piezoelectric actuator.

The movable signal line may be configured to have a rigidity enough to prevent a deformation due to a frequent contact operation with the other of the first and the second fixed signal lines.

According to another aspect of an exemplary embodiment of the present invention, there is provided a method of fabricating a piezoelectric MEMS switch comprising forming first and second cavities at a substrate, forming a first sacrificing layer in the first and the second cavities of the substrate, forming first and second fixed signal lines, the first fixed signal line being disposed at a side of the first cavity and the second fixed signal line being disposed symmetrically to the first fixed signal line and having a first end disposed above the second cavity, forming a piezoelectric actuator in alignment with the first and the second fixed signal lines above the first cavity, and forming a movable signal line which comes in contact with and is connected to the piezoelectric actuator and a first end of the first or the second fixed signal line.

The forming a piezoelectric actuator may comprise forming a lower electrode layer, a piezoelectric layer, an upper electrode layer, and a rigid layer in turn on the substrate, wherein the first sacrificing layer is formed in the first cavity, and etching the lower electrode layer, the piezoelectric layer, the upper electrode layer, and the rigid layer in turn from above in a pattern of the piezoelectric actuator.

The forming a movable signal line may comprise forming a second sacrificing layer on the piezoelectric actuator and the first and the second fixed signal lines, forming contact holes which expose a portion of the piezoelectric actuator and the second fixed signal line, forming a plating seed layer on the second sacrificing layer and in the contact holes, forming a third sacrificing layer on the plating seed layer, forming a movable signal line cavity which exposes a portion of the plating seed layer, plating the exposed portion of the plating seed layer which forms a movable signal line, removing the third sacrificing layer and the plating seed layer layered below the third sacrificing layer, removing the second sacrificing layer, and removing the first sacrificing layer filled in the first and the second cavities.

In the forming a piezoelectric actuator, the piezoelectric actuator may be formed to further comprise a plurality of slits formed in a longitudinal direction of the first and the second signal lines.

The forming a piezoelectric actuator may further comprises forming a driving voltage supplying unit which supplies a driving voltage to the lower electrode layer and the upper electrode layer.

The driving voltage supplying unit may be formed by forming a lower electrode layer, a piezoelectric layer, and an upper electrode layer in turn on the substrate, wherein the first sacrificing layer is formed in the first cavity, etching the lower electrode layer, the piezoelectric layer, and the upper electrode layer in turn from above in a pattern of an upper electrode driving voltage pad, the piezoelectric actuator, and a lower electrode driving voltage pad, forming a rigid layer over the substrate on which the lower electrode driving voltage pad, the piezoelectric actuator, and the upper electrode driving voltage pad are formed, forming first and second via holes, wherein the first via hole exposes the upper electrode layer at a portion of the rigid layer constituting the piezoelectric actuator, and the second via hole exposes the upper electrode layer or the lower electrode layer at another portion of the rigid layer, or the rigid layer, the upper electrode layer and the piezoelectric layer constituting the upper electrode driving voltage pad, and forming a connecting pad, filled in the first and the second via holes, which connect the upper electrode layer constituting the piezoelectric actuator to the upper electrode layer or the lower electrode layer constituting the upper electrode driving voltage pad.

The piezoelectric layer may comprise at least one of Pb(Zr, Ti)O3 (PZT), BaTiO3 (barium titanate), indium tin oxide (ITO), ZnO, and AlN.

The upper and the lower electrode layers may comprise at least one of Pt, Rh, Ta, Au, Mo, and AuPt, respectively.

The rigid layer may comprise at least one of Si3N4 (silicon nitride), AlN, polysilicon, tetraethylortho silicate (TEOS), Mo, Ta, Pt and Rh.

The first sacrificing layer may comprise at least one of polysilicon, low temperature oxide (LTO), and TEOS.

The second and the third sacrificing layers may comprise photoresist, respectively.

The first and the second fixed signal lines and the movable signal line may comprise at least one of Rh, Ti, Ta, Pt, AuNi, and Au, respectively.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above aspects and features of the present invention will be more apparent from the description for exemplary embodiments of the present invention taken with reference to the accompanying drawings, in which.

Throughout the drawings, the same drawing reference numerals will be understood to refer to the same elements, features, and structures.

DETAILED DESCRIPTION OF ILLUSTRATIVE, NON-LIMITING EMBODIMENTS OF THE INVENTION

Figure 1:
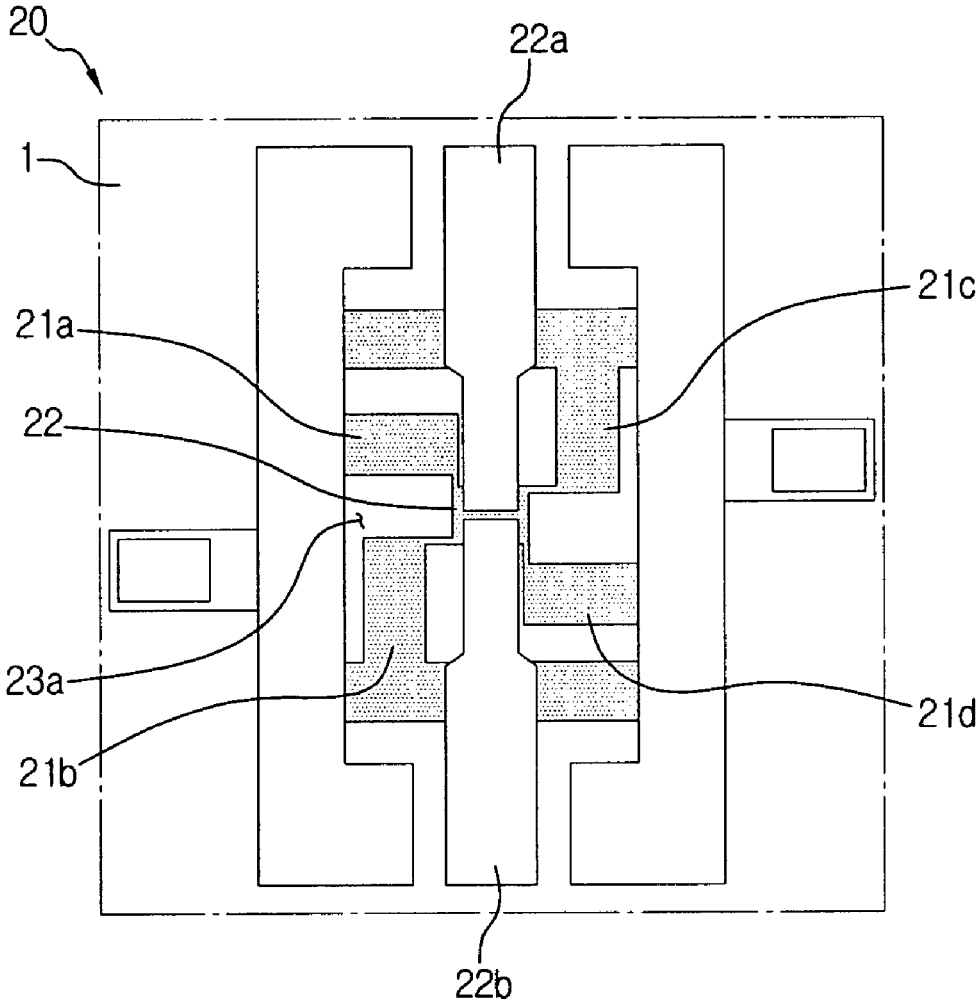
FIG. 1 (PRIOR ART)
FIG. 1 is a top plan view exemplifying a structure of conventional MEMS switch using a piezoelectric actuator.

Reference will now be made in detail to exemplary embodiments of the present invention, which are illustrated in the accompanying drawings, wherein like reference numerals refer to the like elements throughout. The exemplary embodiments are described below in order to explain the present invention by referring to the figures.

Figure 2:
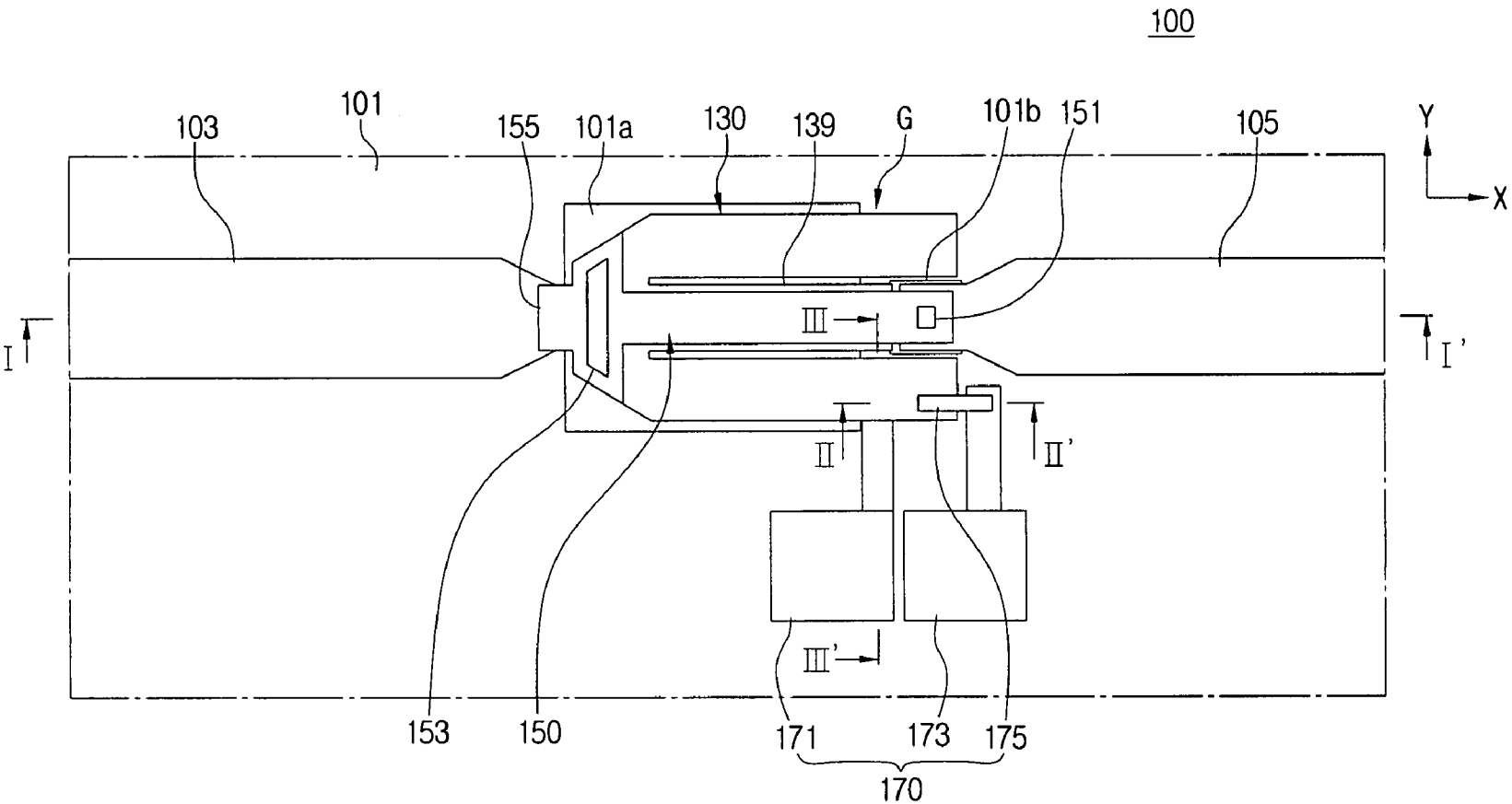
FIG. 2 is a top plan view exemplifying a piezoelectric MEMS switch in accordance with an exemplary embodiment of the present invention.
Figure 3A:
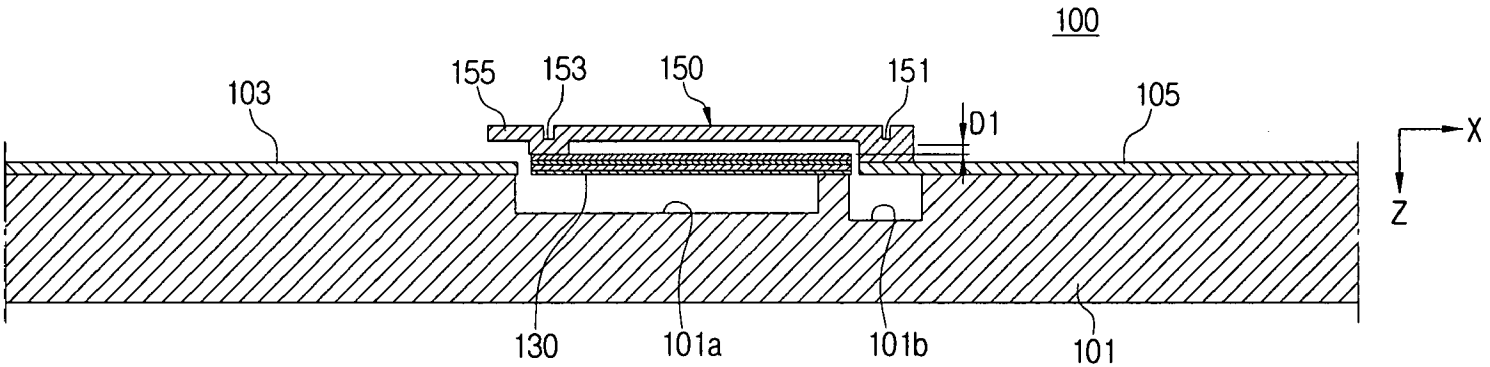
FIG. 3A is a cross-sectional view taken along line I-I' of FIG. 2.
Figure 3B:
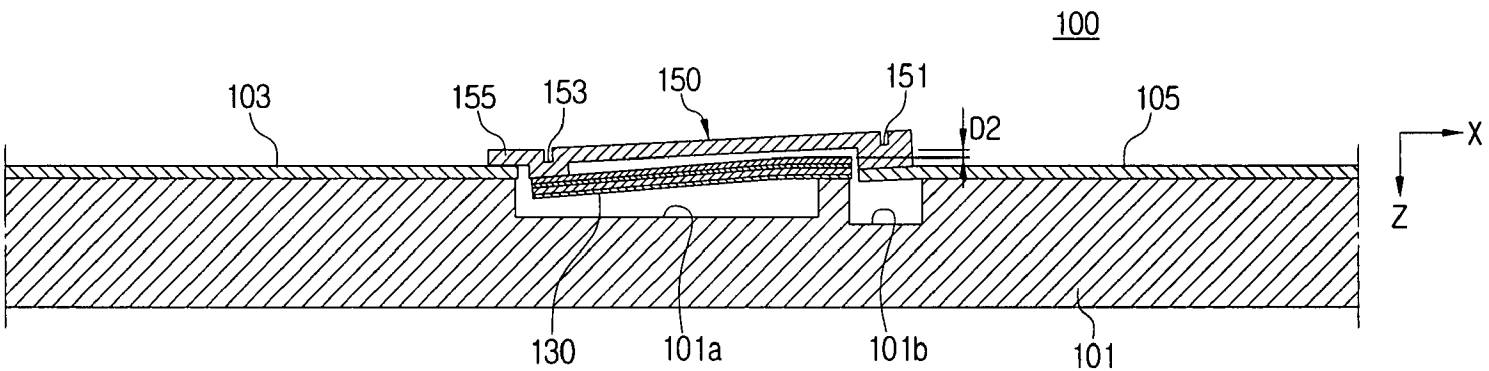
FIG. 3B is a cross-sectional view exemplifying the piezoelectric MEMS switch of FIG. 3A when it is operated.

FIG. 2 is a top plan view exemplifying a piezoelectric MEMS switch in accordance with an exemplary embodiment of the present invention, FIG. 3A is a cross-sectional view taken along line I-I' of FIG. 2, and FIG. 3B is a cross-sectional view exemplifying the piezoelectric MEMS switch of FIG. 3A when it is operated.

Referring to FIGS. 2 through 3B, the piezoelectric MEMS switch in accordance with the exemplary embodiment of the present invention includes a substrate 101, first and second fixed signal lines 103 and 105, a piezoelectric actuator 130, and a movable signal line 150.

The first and the second fixed signal lines 103 and 105 are symmetrically formed in a spaced-apart relation to each other on an upper surface of the substrate 101 to have a predetermined gap G therebetween. The piezoelectric actuator 130 is disposed in alignment with the first and second fixed signal lines 103 and 105 in the predetermined gap G, and at a first end thereof, supported on the substrate 101 to be movable up and down. The movable signal line 150 at least one side thereof (that is, a left side of drawings) is fixed to an upper surface of the piezoelectric actuator 130. The movable signal line 150 has a first end and a second end. The first end of the movable signal line 150 is connected to one of the first and the second fixed signal lines 103 and 105. In the drawings, the first end of the movable signal line 150 is connected to an upper surface of the second fixed signal line 105. The second end of the movable signal line 150 is configured to be in contact with, or move away from the other of the first and second fixed signal lines 103 and 105, that is, the first fixed signal lines 103.

The substrate 101 has a first cavity 101*a* formed below the predetermined gap G to allow the piezoelectric actuator 130 to be movable down. At a side of the first cavity 101*a* is formed a second cavity 101*b* so as to waft a first end of the second fixed signal line 105.

The movable signal line 150 includes a first support 151, a second support 153, and a contact 155. The first support 151 is configured to support the first end of the movable signal line 150 in a spaced-apart relation with a predetermined distance D1 from the upper surface of the piezoelectric actuator 130, with being in contact with and being connected to the first end of the second fixed signal line 105 wafted by the second cavity 101*b*. The second support 153 is configured to support the second end of the movable signal line 150 in a spaced-apart relation with the predetermined distance D1 from and on the upper surface of the piezoelectric actuator 130. The contact 155 is extended from the second end of the movable signal line 150 to selectively come in contact with the first fixed signal line 103. The contact 155 is positioned to project from a second end of the piezoelectric actuator 130 and over a first end of the first fixed signal line 103.

The movable signal line 150 is formed to have a predetermined rigidity enough to prevent the contact 155 from being deformed due to a frequent contact operation with the first fixed signal line 103. For this, the movable signal line 150 is formed in a thickness thicker than that of the first and second fixed signal lines 103 and 105. For instance, the first and second fixed signal lines 103 and 105 is formed in a thickness of the 1.5 μm, whereas the movable signal line 150 is formed in a thickness of 2~3 μm.

When to maintain the predetermined rigidity, the thickness of the movable signal line 150 becomes too thick, it can be difficult to move the movable signal line 150 up and down.

To solve the problem, the first end of the second fixed signal line 105 is configured to waft above the second cavity 101*b*, and the movable signal line 150 is fixed on the upper surface of the first end of the second fixed signal line 105 by the first support 151. Accordingly, during upward and downward movement, the movable signal line 150 can flexibly move (see FIG. 3B).

The movable signal line 150 described above is configured in a spaced-apart relation with the predetermined distance D1 from the piezoelectric actuator 130, so that a leakage or loss of RF signal into the substrate 101 along the piezoelectric actuator 130 is reduced.

Also, the movable signal line 150 has an one-point contact structure that it comes in contact with the upper surface of the first end of the second fixed signal line 105 through the first support 151, thereby reducing a loss of RF signal.

Figure 4:
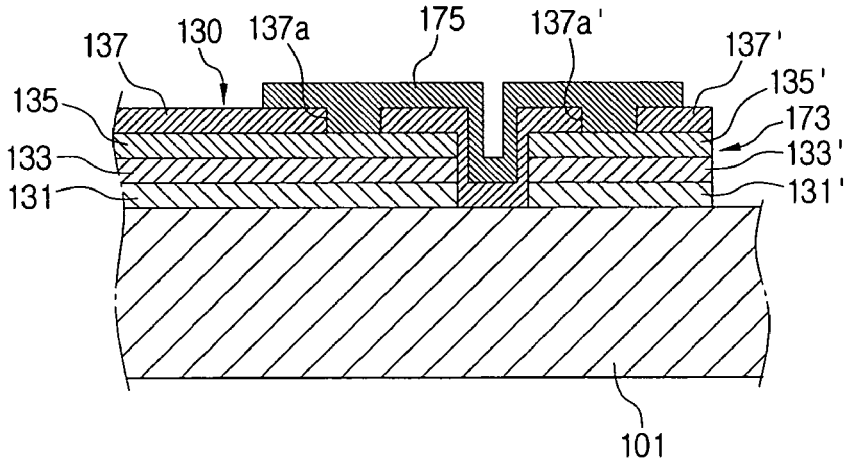
FIG. 4 is a cross-sectional view taken along line II-II' of FIG. 2.
Figure 5:
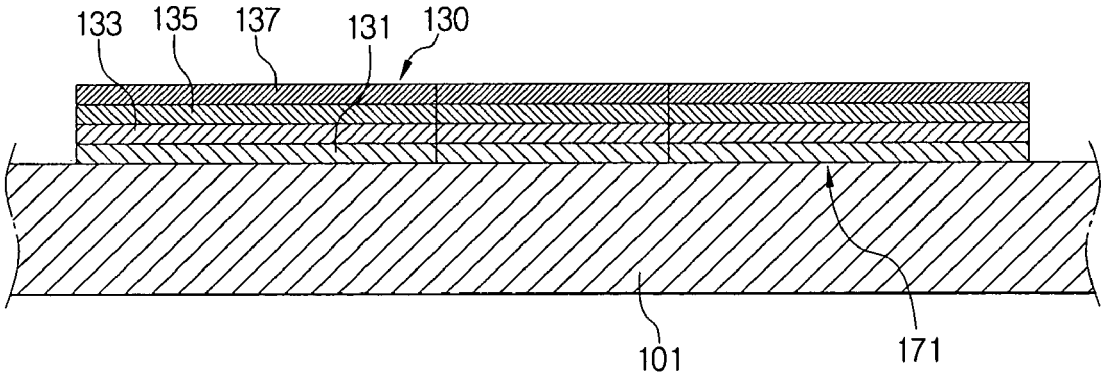
FIG. 5 is a cross-sectional view taken along line III-III' of FIG. 2.

FIG. 4 is a cross-sectional view taken along line II-II' of FIG. 2, and FIG. 5 is a cross-sectional view taken along line II-III' of FIG. 2.

Referring to FIGS. 4 and 5, the piezoelectric actuator 130 includes a lower electrode layer 131, a piezoelectric layer 133 formed on the lower electrode layer 131, an upper electrode layer 135 formed on the piezoelectric layer 133, and a rigid layer 137 formed on the upper electrode layer 135.

When the lower electrode layer 131 and the upper electrode layer 135 are applied with a DC driving voltage, an electric field is produced to the piezoelectric layer 133, and thereby the piezoelectric layer 133 is subject to a dipole moment. At this time, since the rigid layer 137 is located on the upper electrode layer 135, the piezoelectric actuator 130 is bended down.

The piezoelectric actuator 130 has a plurality of slits 139 formed in a longitudinal direction of the first and the second fixed signal limes 103 and 105 (see FIGS. 2, 3A and 3B). The slits 139 divide the piezoelectric actuator 130 into a plurality of sections, each of which is deformable in a direction of Y axis. Accordingly, the piezoelectric actuator 130 can be easily bended toward the substrate 101, that is, in a direction of Z axis, thereby a downward driving performance of the piezoelectric actuator 130 being improved.

The piezoelectric MEMS switch 100 further includes a driving voltage supplying unit 170 to supply a driving voltage to the lower and the upper electrode layers 131 and 135 of the piezoelectric actuator 130.

The driving voltage supplying unit 170 is provided with a lower electrode driving voltage pad 171, an upper electrode driving voltage pad 173, and a connecting pad 175.

The lower electrode driving voltage pad 171 is disposed at a side of the substrate 101 and connected to the lower electrode layer 131 of the piezoelectric actuator 130. The upper electrode driving voltage pad 173 is disposed apart from a side of the piezoelectric actuator 130 and connected the upper electrode layer 135 of the piezoelectric actuator 130 through the connecting pad 175 to supply a voltage thereto.

The lower and the upper electrode driving voltage pads 171 and 173 are formed of the same four layers as those of the piezoelectric actuator 130. In the drawing (see FIG. 4), the layers constituting the upper electrode driving voltage pad 173 are designated as separate reference numerals 131', 133', 135' and 137' for clarity and conciseness.

The connecting pad 175 is filled in a first via hole 137*a* formed at the rigid layer 137 of the piezoelectric actuator 130, and a second via hole 137*a'* formed at the rigid layer 137' of the upper electrode driving voltage pad 173.

Here, the second via hole 137*a'* can be configured to penetrate up to a dielectric layer, that is, the piezoelectric layer 133', so that the connecting pad 175 comes in contact with the lower electrode layer 131' and thus connects the upper electrode layer 135 of the piezoelectric actuator 130 thereto.

Hereinafter, an operation of the piezoelectric MEMS switch 100 constructed as above will be described in details.

First, the lower and the upper electrode layers 131 and 135 of the piezoelectric actuator 130 are applied with a DC voltage through the lower and the upper electrode driving voltage pads 171 and 173.

As a result, a dipole moment to the piezoelectric actuator 130 is produced, and thereby the piezoelectric actuator 130 is bended down. With the piezoelectric actuator 130 being bended down, the movable signal line 150 supported on the piezoelectric actuator 130 moves down along with the piezoelectric actuator 130 to bring the contact 155 of the movable signal line 150 in contact with the upper surface of the first fixed signal line 103 and thus to transmit an RF signal.

At this time, since the first support 151 of the movable signal line 150 is connected to the upper surface of the wafted first end of the second fixed signal line 105, the movable signal line 150 can be flexibly driven down without any obstacle.

Hereinafter, a process of fabricating the piezoelectric MEMS switch 100 described as above will be described in details.

FIGS. 6A through 6J are views exemplifying the process of fabricating the piezoelectric MEMS switch in accordance with the exemplary embodiment of the present invention.

Figure 6A:
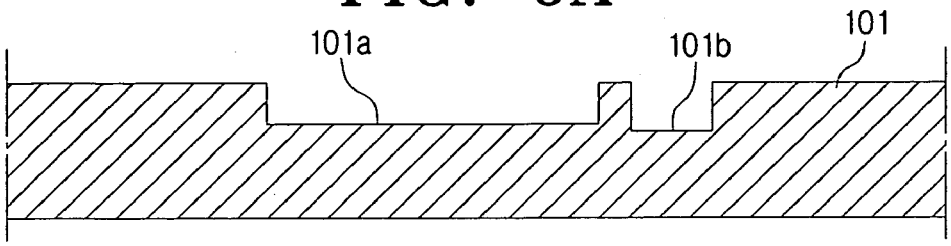
FIGS. 6A through 6J are views exemplifying a process of fabricating the piezoelectric MEMS switch in accordance with the exemplary embodiment of the present invention.

Referring to FIG. 6A, first and second cavities 101*a* and 101*b* are formed at an upper surface of the substrate 101.

Here, the substrate 101 can use, e.g., a high resistivity silicon wafer, a general silicon wafer, a glass wafer, and a wafer made of quartz, fused silica and etc.

The first and the second cavities 101*a* and 101*b* can be formed by an etching process.

Figure 6B:
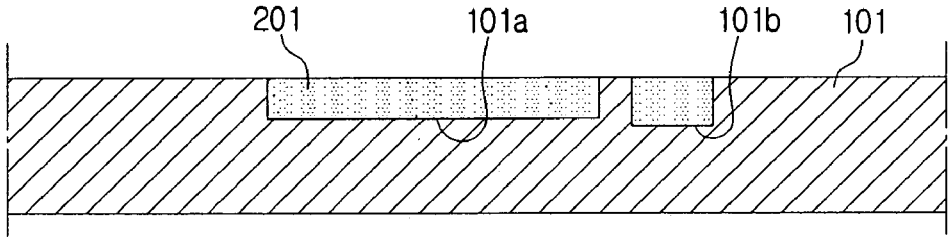

Referring to FIG. 6B, a first sacrificing layer 201 is deposited on the upper surface of the substrate 101, and then planarized.

The first sacrificing layer 201 can be formed of a polysilicon, a low temperature oxide (LTO), or a tetraethylortho silicate (TEOS).

Preferably, but not necessarily, the first sacrificing layer 201 is formed of a heat-resistant material, because a piezoelectric actuator 130 is formed at a high temperature in the following process.

The planarization of the first sacrificing layer 201 can be carried out by, e.g., a chemical mechanical polishing process.

Figure 6C:
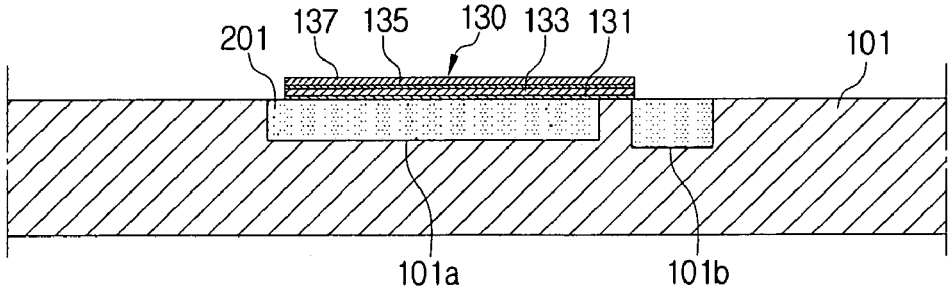

Referring to FIG. 6C, in order to form the piezoelectric actuator 130, a lower electrode layer 131, a piezoelectric layer 133, an upper electrode layer 135, and a rigid layer are deposited in order on the upper surface of the substrate 101 on which the first sacrificing layer 201 is deposited and planarized, and then etched in order from above in a pattern of the piezoelectric actuator 130. At this time, a plurality of slits 139 can be additionally etched and formed in a longitudinal direction of the piezoelectric actuator 130 (see FIG. 2).

Here, the lower and the upper electrode layer 131 and 135 can be formed of Pt, Rh, Ta, Au, Mo or AuPt. Also, the deposition of the lower and the upper electrode layers 131 and 135 can be carried out by, e.g., a sputtering method, a thermal evaporation method, an E-beam evaporation method, a physical vapor deposition (PVD) method, an electro-plating method, an electroless plating method, etc.

The piezoelectric layer 133 can be formed of $Pb(Zr, Ti)O_3$ (PZT), $BaTiO_3$ (barium titanate), indium tin oxide (ITO), ZnO, or AlN. The piezoelectric layer 133 can be formed by carrying out a rapid thermal annealing process after depositing by using a sputtering method or a chemical vapor deposition (CVD) method, or by carrying out the rapid thermal annealing process after sintering by using a sol-gel method.

The rigid layer 137 can be formed of $Si_3N_4$ (silicon nitride), AlN, polysilicon, TEOS, Mo, Ta, or Rh. The deposition of the rigid layer 137 can be carried out by, e.g., a sputtering method, a CVD method, a PVD method, a sintering method using the sol-gel method, a thermal oxidation method, a pulse laser deposition (PLD) method, etc.

While the piezoelectric actuator 130 is formed as described above, a driving voltage supplying unit 170 can be further formed.

Referring to FIGS. 2, 4 and 5, the driving voltage supplying unit 170 is formed together with the piezoelectric actuator 130. More specifically, after the lower electrode layer 131, the piezoelectric layer 133, and the upper electrode layer 135 are deposited in turn to form the piezoelectric actuator 130, they are etched in a pattern of the piezoelectric actuator 130 and the driving voltage supplying unit 170.

The driving voltage supplying unit 170 has a lower electrode driving voltage pad 171 and an upper electrode driving voltage pad 173. The lower electrode driving voltage pad 171 is etched to connect with the piezoelectric actuator 130 (see FIG. 5). The upper electrode driving voltage pad 173 is etched to separate from the piezoelectric actuator 130 (see FIG. 4).

In such a state, the rigid layer 137 is deposited over the substrate 101. And then, first and second via holes 137*a* and 137*a*' are formed at the rigid layer 137 of the piezoelectric actuator 130 and the rigid layer 137' of the upper electrode driving voltage pad 173, respectively (see FIG. 5), and then a connecting pad 175 is formed.

Here, although the second via hole 137*a*' has been illustrated as configured to penetrate up to the rigid layer 137', it can be configured to penetrate up to a dielectric layer, that is, a piezoelectric layer 133', so that the upper electrode layer 135 of the piezoelectric actuator 130 is connected to the lower electrode layer 131' of the upper electrode driving voltage pad 173 through the connecting pad 175.

Figure 6D:
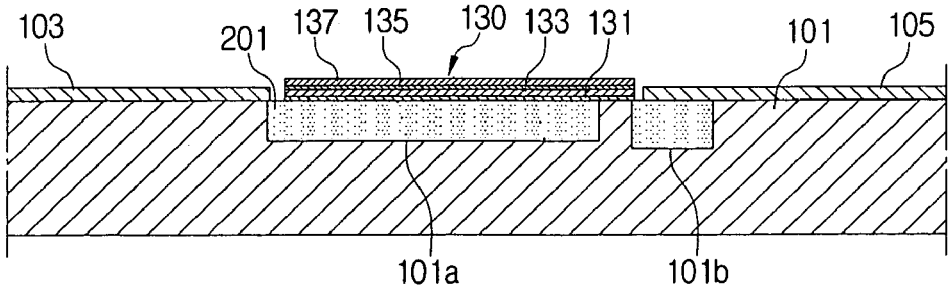

Referring to FIG. 6D, first and second fixed lines 103 and 105, which an RF signal is input to and output from, are formed. At this time, the second fixed line 105 is formed, such that a first end of the second fixed line 105 is located on an upper surface of the second sacrificing layer 210 filled in the second cavity 101*b*.

The first and the second fixed lines 103 and 105 can be formed of a conductive metal, e.g., Au, Rh, Ti, Ta, Pt or AuNi, respectively. Like as the upper and the lower electrode layers 135 and 131 constituting the piezoelectric actuator 130, the first and the second fixed lines 103 and 105 are formed by, e.g., a sputtering method, a thermal evaporation method, an E-beam evaporation method, a PVD method, an electro-plating method, an electroless plating method, etc.

Figure 6E:
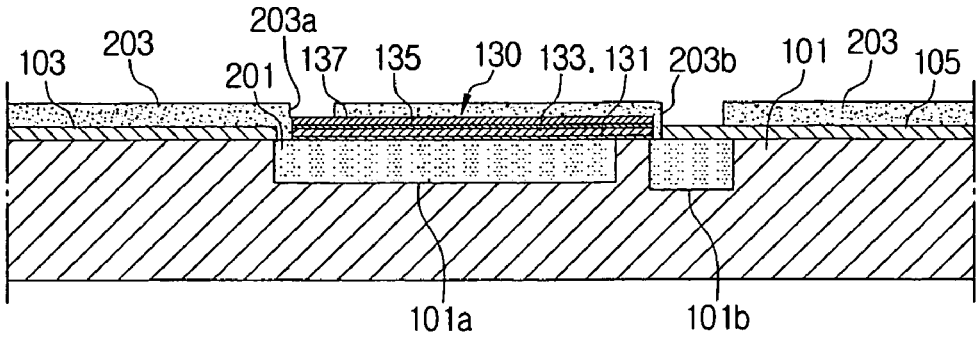

Referring to FIG. 6E, a second sacrificing layer 203 is deposited over the substrate 101 on which the piezoelectric actuator 130 and the first and the second fixed signal lines 103 and 105 are formed, and then contact holes 203*a* and 203*b* are formed. Here, the second sacrificing layer 203, which functions to separate a movable signal line 150 to be formed later from the upper surface of the piezoelectric actuator 130, can be formed of, e.g., a photoresist. The photoresist can be coated by, e.g., a spin coating method.

Figure 6F:
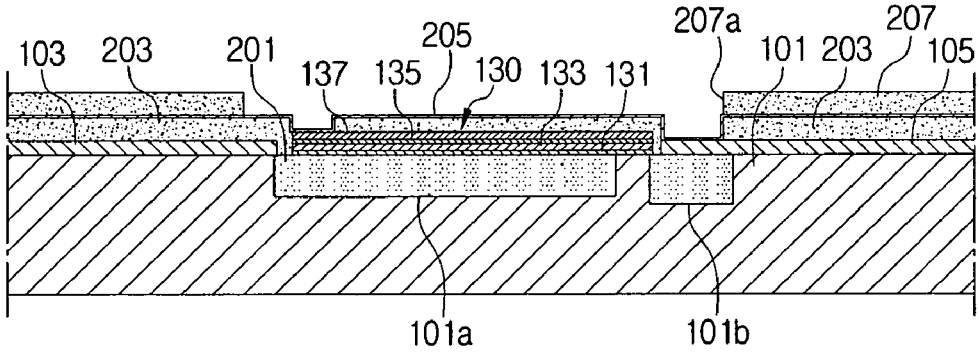

Referring to FIG. 6F, a plating seed layer 205 is deposited on an upper surface of the second sacrificing layer 203, and then a third sacrificing layer 207 is deposited. Subsequently, a movable signal line cavity 207*a* is formed in a pattern corresponding to the movable signal line 150 at the third sacrificing layer 207, which acts as a plating mask for forming the movable signal line 150.

Figure 6G:
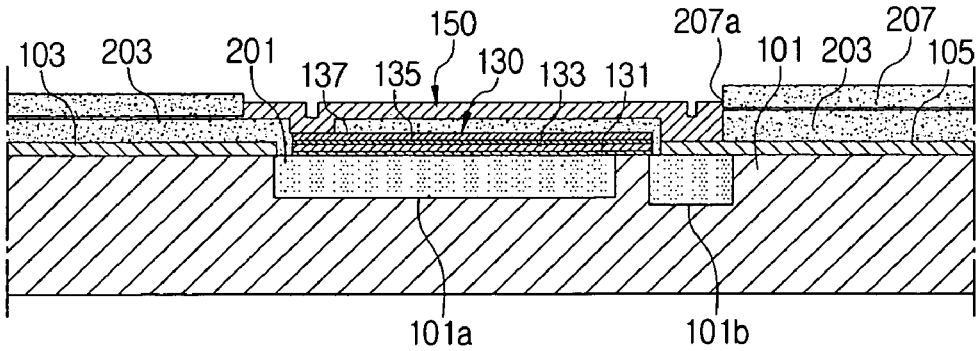

Referring to FIG. 6G, a portion of the plating seed layer 205, which is exposed by the movable signal line cavity 207*a*, is plated. As a result, the movable signal line 150 is formed in a predetermined thickness.

Figure 6H:
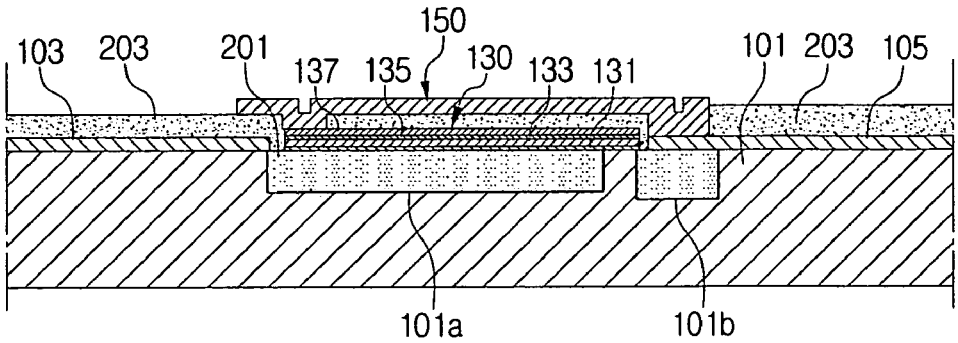

Referring to FIG. 6H, the third sacrificing layer 207 and the plating seed layer 205 located below the third sacrificing layer 207 are removed.

Figure 6I:
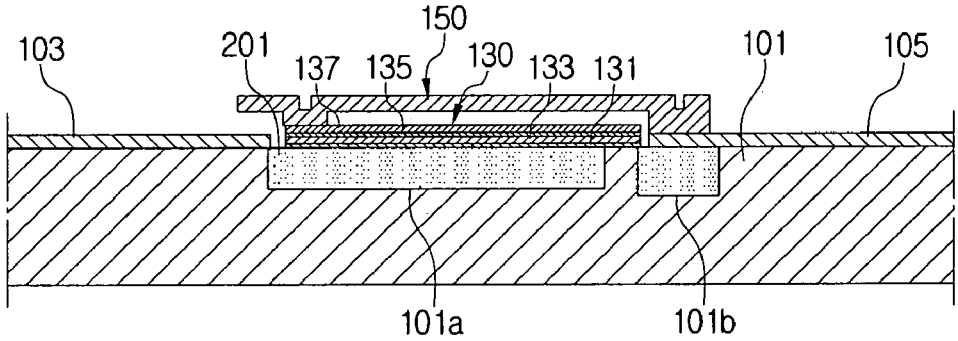

Referring to FIG. 6I, the second sacrificing layer 203 is removed to complete a formation of the movable signal line 150.

Figure 6J:
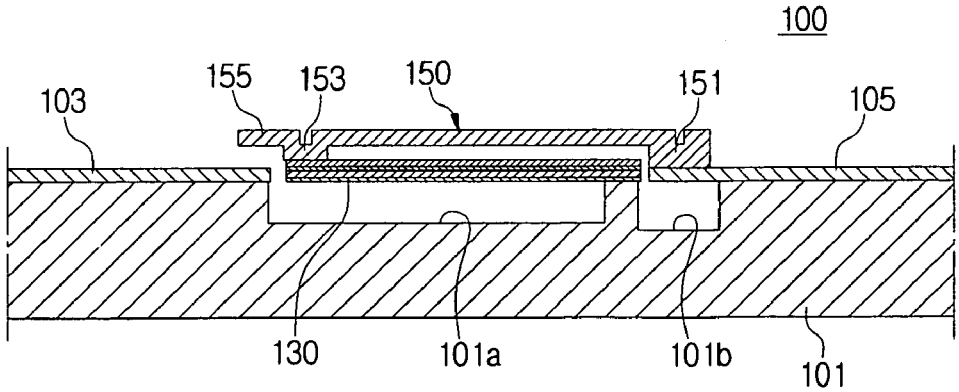

Referring to FIG. 6J, the first sacrificing layer 201 is removed, and the process of fabricating the switch is completed. Here, the first sacrificing layer 201 can be removed by, e.g., $XeF_2$ vaporization etching method.

According to the piezoelectric MEMS switch of the exemplary embodiment of the present invention as described above, the RF signal lines are distributed after the piezoelectric actuator is formed, thereby removing the troublesome process of unreasonably etching the undersurface of the substrate.

Further, according to the piezoelectric MEMS switch of the exemplary embodiment of the present invention, the movable signal line has an one-point contact structure that it has the first end supported on the first end of the second fixed signal line and the second end to selectively come in contact with the first fixed signal line, thereby reducing the loss of RF signal.

Also, according to the piezoelectric MEMS switch of the exemplary embodiment of the present invention, the movable signal line is configured in a spaced-apart relation with the predetermined distance from the piezoelectric actuator. Accordingly, the leakage of RF signal into the substrate along the piezoelectric actuator is reduced.

Also, according to the piezoelectric MEMS switch of the exemplary embodiment of the present invention, the movable signal line is connected to and supported on the upper surface of the wafted first end of the second fixed signal line. Accordingly, when the piezoelectric actuator is driven down, the movable signal line can be flexibly moved, thereby improving the driving performance of the piezoelectric actuator.

Although a few exemplary embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A piezoelectric Micro Electro Mechanical System (MEMS) switch comprising:

a substrate;

first and second fixed signal lines symmetrically formed in a spaced-apart relation to each other on the substrate to have a predetermined gap therebetween;

a piezoelectric actuator disposed in alignment with the first and the second fixed signal lines in the predetermined gap, and comprising a first end supported on the substrate to allow the piezoelectric actuator to be movable up and down; and a movable signal line comprising a first end connected to one of the first and the second fixed signal lines, and a second end configured to be in contact with, or separate from the other of the first and second fixed signal lines, at least one side of the movable signal line being connected to an upper surface of the piezoelectric actuator, wherein the substrate has a first cavity formed below the predetermined gap to allow the piezoelectric actuator to be movable down, and wherein the substrate has a second cavity formed at a side of the first cavity to waft a first end of the one of the first and the second fixed signal lines.

2. The piezoelectric MEMS switch as claimed in claim 1, wherein the movable signal line comprises:

a first support which supports the first end of the movable signal line in a spaced-apart relation from the piezoelectric actuator, the first support being in contact with the first end of the one of the first and the second fixed signal lines wafted by the second cavity;

a second support which supports the second end of the movable signal line in a spaced-apart relation from and on the upper surface of the piezoelectric actuator; and a contact which is extended from the second end of the movable signal line and selectively comes in contact with the other of the first and the second fixed signal lines.

3. The piezoelectric MEMS switch as claimed in claim 1, wherein the piezoelectric actuator comprises:

a lower electrode layer;

a piezoelectric layer formed on the lower electrode layer;

an upper electrode layer formed on the piezoelectric layer; and a rigid layer formed on the upper electrode layer.

4. The piezoelectric MEMS switch as claimed in claim 3, wherein the piezoelectric actuator further comprises a plurality of slits formed in a longitudinal direction of the first and the second fixed signal lines.

5. The piezoelectric MEMS switch as claimed in claim 3, further comprising a driving voltage supplying unit which supplies a driving voltage to the upper and the lower electrode layers.

6. The piezoelectric MEMS switch as claimed in claim 5, wherein the driving voltage supplying unit comprises:

a lower electrode driving voltage pad which is disposed at a side of the substrate and connected to the lower electrode layer of the piezoelectric actuator;

an upper electrode driving voltage pad which is disposed at a side of the piezoelectric actuator and supplies a voltage to the upper electrode layer of the piezoelectric actuator; and a connecting pad which connects the upper electrode driving voltage pad to the upper electrode layer of the piezoelectric actuator.

7. The piezoelectric MEMS switch as claimed in claim 6, wherein at least one the lower electrode driving voltage pad and the upper electrode driving voltage pad comprises four layers which are respectively aligned with the lower electrode layer, the piezoelectric layer, the upper electrode layer and the rigid layer of the piezoelectric actuator.

8. The piezoelectric MEMS switch as claimed in claim 1, wherein the movable signal line is formed such that a thickness of the movable signal line is greater than a thickness of the first or second fixed signal line.

9. A method of fabricating a piezoelectric Micro Electro Mechanical System (MEMS) switch comprising:

forming first and second cavities at a substrate;

forming a first sacrificing layer in the first and the second cavities of the substrate;

forming first and second fixed signal lines, the first fixed signal line being disposed at a side of the first cavity and the second fixed signal line being disposed symmetrically to the first fixed signal line and having a first end disposed above the second cavity;

forming a piezoelectric actuator in alignment with the first and the second fixed signal lines above the first cavity; and forming a movable signal line which comes in contact with and is connected to the piezoelectric actuator and a first end of the first or the second fixed signal line.

10. The method as claimed in claim 9, wherein the forming a piezoelectric actuator comprises:

forming a lower electrode layer, a piezoelectric layer, an upper electrode layer, and a rigid layer in turn on the substrate, wherein the first sacrificing layer is formed in the first cavity; and etching the lower electrode layer, the piezoelectric layer, the upper electrode layer, and the rigid layer in turn from above in a pattern of the piezoelectric actuator.

11. The method as claimed in claim 9, wherein the forming a movable signal line comprises:

forming a second sacrificing layer on the piezoelectric actuator and the first and the second fixed signal lines;

forming contact holes which expose a portion of the piezoelectric actuator and the second fixed signal line;

forming a plating seed layer on the second sacrificing layer and in the contact holes;

forming a third sacrificing layer on the plating seed layer;

forming a movable signal line cavity which exposes a portion of the plating seed layer;

plating the exposed portion of the plating seed layer which forms a movable signal line;

removing the third sacrificing layer and the plating seed layer layered below the third sacrificing layer;

removing the second sacrificing layer; and removing the first sacrificing layer filled in the first and the second cavities.

12. The method as claimed in claim 10, wherein the pattern of piezoelectric actuator further comprises a plurality of slits formed in a longitudinal direction of the first and the second signal lines.

13. The method as claimed in claim 10, wherein the forming a piezoelectric actuator further comprises forming a driving voltage supplying unit which supplies a driving voltage to the lower electrode layer and the upper electrode layer.

14. The method as claimed in claim 13, wherein the forming a piezoelectric actuator comprises:

forming a lower electrode layer, a piezoelectric layer, and an upper electrode layer in turn on the substrate, wherein the first sacrificing layer is formed in the first cavity;

etching the lower electrode layer, the piezoelectric layer, and the upper electrode layer in turn from above in a pattern of an upper electrode driving voltage pad, the piezoelectric actuator, and a lower electrode driving voltage pad, wherein the driving voltage supplying unit comprises the upper electrode driving voltage pad and the lower electrode driving voltage pad;

forming a rigid layer over the substrate on which the lower electrode driving voltage pad, the piezoelectric actuator, and the upper electrode driving voltage pad are formed;

forming first and second via holes, wherein the first via hole exposes the upper electrode layer at a portion of the rigid layer constituting the piezoelectric actuator, and the second via hole exposes the upper electrode layer or the lower electrode layer at another portion of the rigid layer, or the rigid layer, the upper electrode layer and the piezoelectric layer constituting the upper electrode driving voltage pad; and forming a connecting pad, filled in the first and the second via holes, which connects the upper electrode layer constituting the piezoelectric actuator to the upper electrode layer or the lower electrode layer constituting the upper electrode driving voltage pad.

15. The method as claimed in claim 10, wherein the piezoelectric layer comprises at least one of $Pb(Zr, Ti)O_3$, $BaTiO_3$, indium tin oxide (ITO), ZnO, and AlN.

16. The method as claimed in claim 10, wherein the upper and the lower electrode layers comprise at least one of Pt, Rh, Ta, Au, Mo, and AuPt, respectively.

17. The method as claimed in claim 10, wherein the rigid layer comprises at least one of $Si_3N_4$, AlN, polysilicon, tetraethylortho silicate (TEOS), Mo, Ta, Pt and Rh.

18. The method as claimed in claim 10, wherein the first sacrificing layer comprises at least one of polysilicon, low temperature oxide (LTO), and TEOS.

19. The method as claimed in claim 11, wherein the second and the third sacrificing layers comprise photoresist, respectively.

20. The method as claimed in claim 9, wherein the first and the second fixed signal lines and the movable signal line comprise at least one of Rh, Ti, Ta, Pt, AuNi, and Au, respectively.

* * * * *